US005876228A

United States Patent [19]

Hayashi

[11] Patent Number: 5,876,228

[45] Date of Patent: Mar. 2, 1999

[54] CONNECTOR CONNECTING STRUCTURE

[75] Inventor: Hiroyuki Hayashi, Nagoya, Japan

[73] Assignees: Harness System Technologies Research, Ltd., Nagoya; Sumitomo Wiring Sytems, Ltd., Yokkaichi; Sumitomo Electric Industries, Ltd., Osaka, all of Japan

[21] Appl. No.: 820,384

[22] Filed: Mar. 12, 1997

[30] Foreign Application Priority Data

Mar. 18, 1996 [JP] Japan ..... 8-060691

[51] Int. Cl.[6] ..... H01R 13/64

[52] U.S. Cl. ..... 439/248; 439/701

[58] Field of Search ..... 439/248, 247, 439/246, 249, 250, 251, 252, 701

[56] References Cited

U.S. PATENT DOCUMENTS 1,531,917 3/1925 French ..... 439/251

2,999,998 9/1961 Cole ..... 439/252

FOREIGN PATENT DOCUMENTS 64-27982 U 2/1989 Japan .

1-122278 U 8/1989 Japan .

*Primary Examiner*—Khiem Nguyen

*Assistant Examiner*—Eugene G. Byrd

*Attorney, Agent, or Firm*—Oliff & Berridge, PLC

[57] ABSTRACT

A connector connecting structure comprises a first connector supported on a mounting portion, and a second connector connected to the first connector. A spherical support portion is formed in a projected manner on one of a bottom of the first connector and a wall surface of the mounting portion, while a holding portion for holding the support portion is provided on the other, and when connecting the second connector to the first connector, the first connector is pivotally displaced about the support portion.

8 Claims, 4 Drawing Sheets

CONNECTOR CONNECTING STRUCTURE

BACKGROUND OF THE INVENTION

1. Field of the Invention

This invention relates to a connector connecting structure for electrically connecting a pair of mating connectors together.

2. Description of the Related Art

In a conventional structure as disclosed in Japanese Utility Model Unexamined Publication No. 64-27982, a ring-like spring member and a guide flange, which are adapted to be fitted in a guide groove formed in a mounting portion such as a body panel of a vehicle, are provided on a housing of a first connector, and a second connector is resiliently supported by the spring member so that the second connector can move in upward, downward, left and right directions, and with this structure even if the second connector to be connected to the first connector is slightly misregistered with the first connector, this misregistration is absorbed by resiliently deforming the spring member, so that the first and second connectors can be properly connected together.

In the connector connecting structure disclosed in the above publication, the guide flange adapted to be fitted in the guide groove formed in the mounting portion, and the spring member for resiliently supporting the second connector must be provided on the housing of the first connector, and therefore there is a problem that this housing is complicated in structure. And besides, the mounting portion is divided into a fixing panel and a mounting panel, and the two panels are vertically separated from each other, and in this condition the guide flange must be fitted in the guide groove so as to mount the first connector on the mounting portion. Thus, there is a problem that the first connector mounting operation is cumbersome.

And besides, when connecting the two connectors together by fitting the second connector into the first connector fixed to the mounting portion by the guide flange, it is necessary to press the second connector to the first connector with a large force, and this invites a problem that the guide flange of the first connector and a holding portion for holding this guide flange, that is, a wall constituting the guide groove in the mounting portion, are liable to be damaged. Particularly when the mounting angle of the housing of the first connector is out of agreement with that of the housing of the second connector, a large bending moment acts on the guide flange and the holding portion of this guide flange when connecting the two connectors together, which results in a problem that the guide flange or the holding portion is liable to be damaged.

In order to effect an electrical connection of high reliability while preventing damage to connector terminals and a housing, there has been proposed a structure (as disclosed in Japanese Utility Model Unexamined Publication No. 1-122278) in which a pair of shaft portions are formed in a projected manner on one of an outer surface of an inner case (first connector) and an inner surface of an outer case supporting this inner case, and bearing portions for pivotally supporting the respective shaft portions are formed on the other. When a coupler case (second connector) to be connected to the inner case is inserted into the inner case in inclined relation thereto because of a manufacturing error, the inner case is pivotally displaced about the shaft portions so as to absorb this manufacturing error, thereby enabling the inner case and the coupler case to be connected together in a proper condition.

In the above structure, however, the pair of shaft portions need to be formed in a projected manner on one of the outer surface of the inner case and the inner surface of the outer case, and therefore the dimension of the connector in a direction of its width is inevitably increased, and besides the direction of pivotal displacement of the inner case is limited to one direction, and therefore if the coupler case is inclined, for example, in a direction perpendicular to the direction of pivotal displacement of the inner case, there is a problem that the inner case and the coupler case can not be connected together in a proper condition.

SUMMARY OF THE INVENTION

In view of the above problems, it is an object of this invention to provide a connector connecting structure in which a pair of connectors can be easily connected together in a proper condition without increasing the dimension of the connector in a direction of a width thereof.

According to the invention of claim 1, there is provided a connector connecting structure comprising; a first connector supported on a mounting portion; a second connector connected to said first connector; a spherical support portion formed in a projected manner on one of a bottom of said first connector and a wall surface of said mounting portion; and a holding portion for holding said support portion provided on the other; wherein when connecting said second connector to said first connector, said first connector is pivotally displaced about said support portion.

With this structure, when connecting the first and second connectors together in such a condition that the mounting angle of the first connector is out of agreement with the mounting angle of the second connector, the first connector is pivotally moved about the spherical support portion, and therefore the disagreement of the mounting angles is corrected, so that the two connectors can be properly connected together.

BRIEF DESCRIPTION OF THE DRAWINGS

The above and other objects and features of the present invention will be more apparent from the following description taken in conjunction with the accompanying drawings. In the accompanying drawings.

DETAILED DESCRIPTION OF THE PREFERRED EMBODIMENTS

Figure 1:
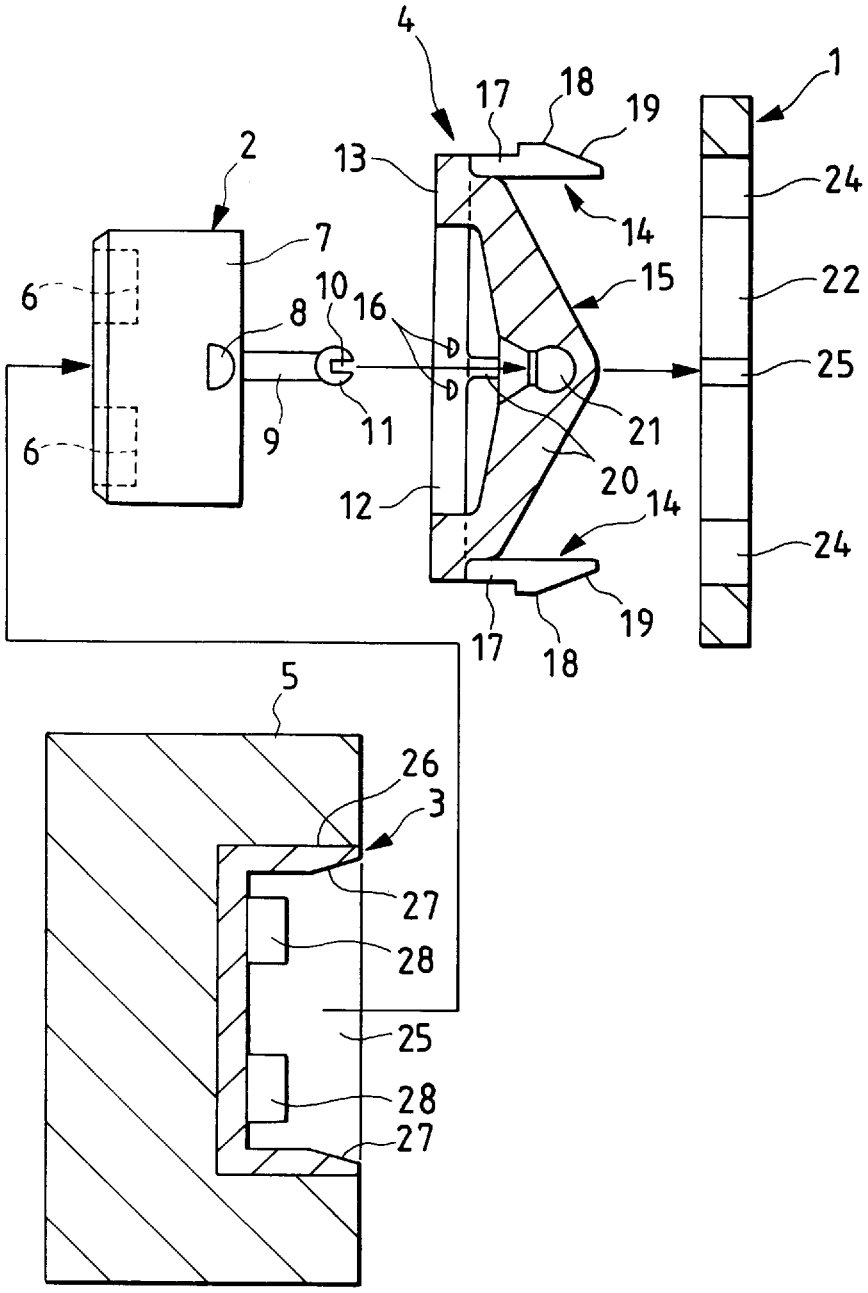
FIG. 1 is a cross-sectional view showing a preferred embodiment of a connector connecting structure of the present invention.
Figure 2:
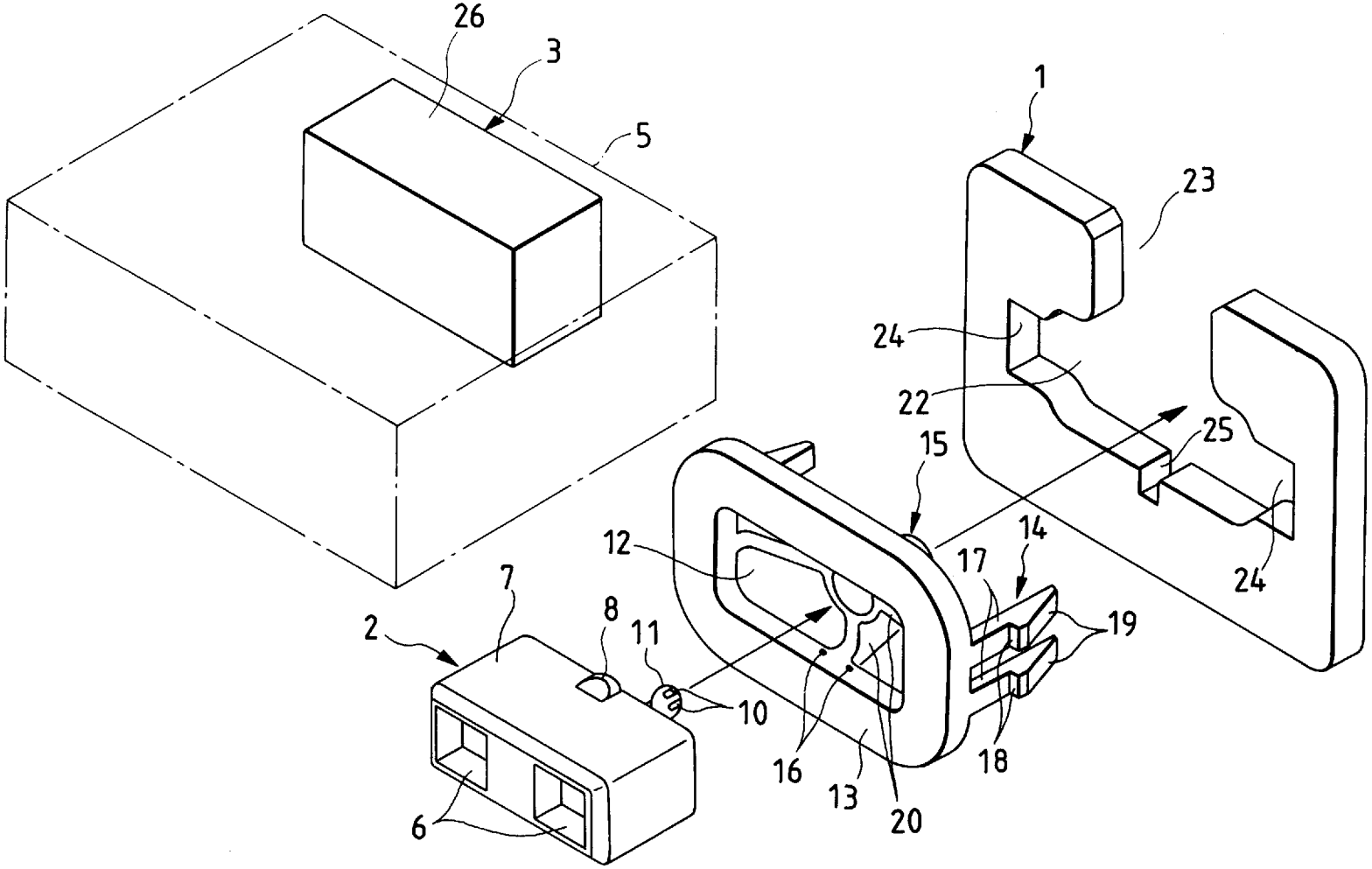
FIG. 2 is a perspective view of the connector connecting structure of the above embodiment.

FIGS. 1 and 2 show a preferred embodiment of a connector connecting structure of the invention. This connector comprises a first connector 2 adapted to be supported on a mounting portion 1 such as an instrument panel of an automobile, and a second connector 3 connected to this first connector 2. The first connector 2 is supported on the mounting portion 1 through a holder 4, and the second connector 3 is mounted integrally on an electronic unit 5 such as a meter unit, an air-conditioning unit or a navigation device.

The first connector 2 includes a male connector housing 7 having terminal receiving chambers 6, and female terminals (not shown) received respectively in these terminal receiving chambers 6. A pair of shake prevention projections 8 are formed respectively on rear portion of upper and lower surfaces of the connector housing 7. A shaft portion 9 is formed on and projects from a bottom surface of the connector housing 7, and a spherical support portion 11, having a cross-shaped slit 10, is formed at a distal end of this shaft portion 9.

The holder 4 includes a frame plate 13 having an opening 12 for receiving a bottom portion of the first connector 2, retaining portions 14 extending respectively from opposite (right and left) side portions of the frame plate 13 at a rear side thereof, and a holding portion 15 for holding the support portion 11 of the first connector 2. A pair of small projections 16 are formed on each of upper and lower sides of the opening 12, and are abutted against the associated shake prevention projection 8 in a supported condition of the first connector 2. The retaining portion 14 comprises a pair of upper and lower legs 17 each having a retaining projection 18 formed at a distal end thereof, and a tapering or slanting surface 19 is formed on an outer surface of the retaining projection 18.

The holding portion 15 includes a support frame 20 projecting from the upper, lower, and right and left sides of the opening 12 at the rear side thereof toward the inside thereof, and a recessed hole 21 formed in an intersection portion of the support frame 20. The recessed hole 21 is formed into a spherical shape corresponding to the support portion 11 formed at the bottom of the first connector 2, and more than a half of the support portion 11 can be received in the recessed hole 21. By press-fitting the support portion 11 into the recessed hole 21, the first connector 2 is connected to the holder 4, and the first connector 2 is supported for pivotal movement about the support portion 11.

The mounting portion 1 comprises a plate having an opening 22 for receiving the holding portion 15 of the holder 4, and a notch 23 is formed in an upper side portion of the mounting portion 1, and a harness of the first connector 2 is fitted into the opening 22 through this notch 23. Recesses 24 for retaining the retaining portions 14 of the holder 4 are formed respectively in opposite (right and left) sides of the opening 22, and a recess 25 for receiving the lower portion of the support frame 20 of the holding portion 15 is formed in a lower side of the opening 22.

The second connector 3 includes a female connector housing 26 having an opening 25 for fitting on the connector housing 7 of the first connector 2. The connector housing 26 has an outwardly-spreading, tapering surface 27 formed at an inlet portion of the opening 25, and terminal connection portions 28, corresponding respectively to the terminal receiving chambers 6, are formed on the connector housing 26, and each of the terminal connection portions 28 has a male terminal to be connected to the associated female terminal of the first connector 2.

For connecting the above first and second connectors 2 and 3 together, first, the support portion 11, formed at the bottom of the first connector 2, is press-fitted into the recessed hole 21 formed in the holding portion 15 of the holder 4, thereby connecting the first connector 2 to the holder 4. The cross-shaped slit 10 is formed in the support portion 11, and therefore when press-fitting the support portion 11 into the recessed hole 21, the support portion 11 is elastically deformed to be reduced in diameter, and therefore can be smoothly press-fitted into the recessed hole 21.

Figure 3:
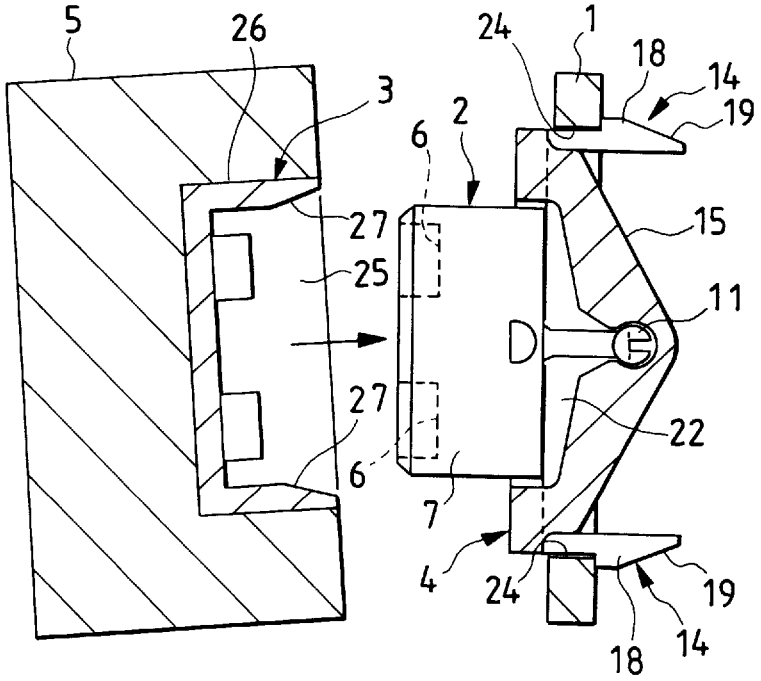
FIG. 3 is a cross-sectional view showing a condition in which a first connector is supported on a mounting portion.

Then, the retaining portions 14, provided at the opposite (right and left) side portions of the holder 4, are press-fitted into the respective recesses 24 formed respectively in the opposite (right and left) side portions of the mounting portion 1, so that the holding portion 15 of the holder 4 is inserted in the opening 22 in the mounting portion 1 as shown in FIG. 3, and in this condition the holder 4 is attached to the mounting portion 1, and the first connector 2 is supported on the mounting portion 1 through this holder 4.

The retaining projections 18 each having the tapering or slanting surface 19 are formed at the distal end of the retaining portion 14, and therefore the tapering surfaces 19 are held in sliding contact with the inner surfaces of the respective recesses 24, and the legs 17 of the retaining portions 14 are elastically deformed, thereby press-fitting the retaining projections 18 into the respective recesses 24, and therefore the holder 4 can be easily shifted into a connected condition in which the rear surface of each retaining projection 18 is abutted against the peripheral edge portion of the associated recess 24.

Then, the electronic unit 5, having the second connector 3 attached thereto, is pushed toward the holder 4 and the first connector 2, and the opening 25 in the connector housing 26 of the second connector 3 is fitted on the connector housing 7 of the first connector 2, thereby connecting the first and second connectors 2 and 3 together.

Figure 4:
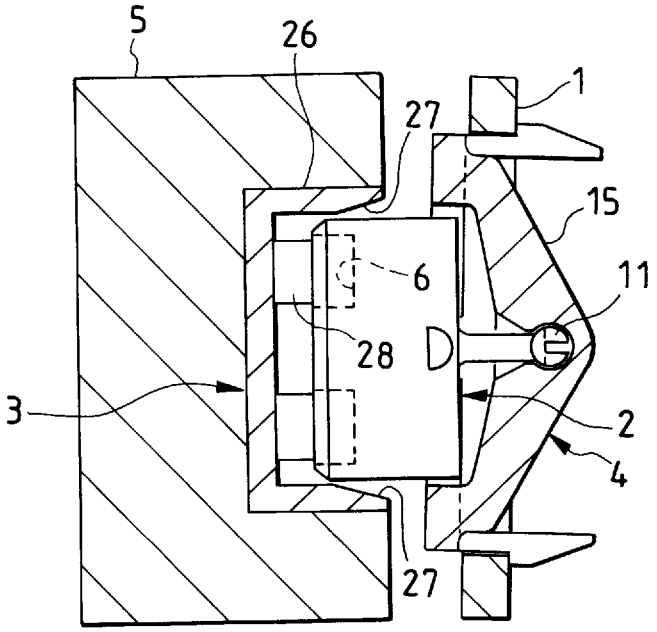
FIG. 4 is a cross-sectional view showing the process of connecting the first and second connectors together.

If the mounting angle of the connector housing 7 of the first connector 2 is out of agreement with that of the connector housing 26 of the second connector 3 when connecting the second connector 3 to the first connector 2, the outwardly-spreading, tapering surface 27, formed on the connecter housing 26 of the second connector 3, is brought into sliding contact with the connector housing 7 of the first connector 2 as shown in FIG. 4, and the connector housing 26 of the second connector 3 is fitted on the connector housing 7 of the first connector 2.

Figure 5:
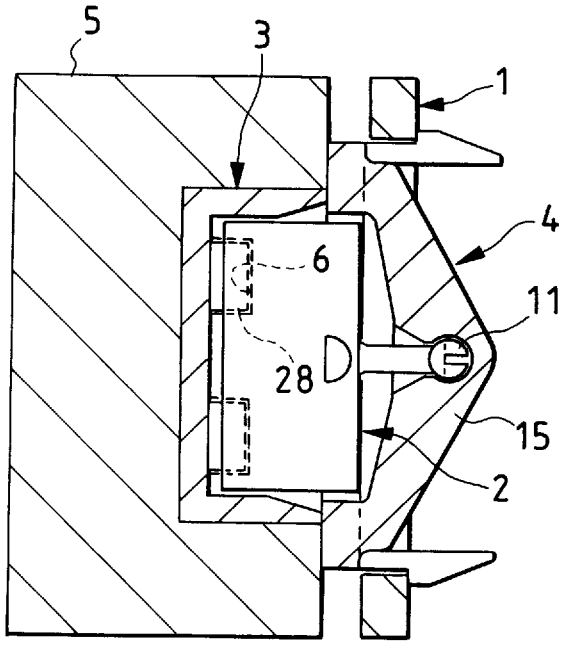
FIG. 5 is a cross-sectional view showing a condition of connection between the first and second connectors.

The first connector 2 is supported for pivotal movement about the spherical support portion 11, and therefore in accordance with the movement of the front side of the connector housing 7 into the opening 25 along the tapering surface 27, the support portion 11 is pivotally moved on the surface of the recessed hole 21, so that the first connector 2 is pivotally displaced into a mounting angle corresponding to the angle of advance of the second connector 3, and the angle of advance of the second connector 3 is corrected in accordance with this mounting angle of the first connector 2. Therefore, as shown in FIG. 5, the connector housing 26 of the second connector 3 is properly fitted on the connector housing 7 of the first connector 2, thus connecting the two together, and the terminal connection portions 28 of the second connector 3 are inserted respectively into the terminal receiving chambers 6 in the first connector 2, so that the terminals are connected together.

Thus, the spherical support portion 11 is formed at the bottom of the first connector 2, and the holding portion 15 for holding the support portion 11 is provided at the holder 4 mounted on the mounting portion 1, and when connecting the second connector 3 to the first connector 2, the first connector 2 is pivotally displaced about the spherical support portion 11. With this structure, even if the angle of advance of the second connector 3 is out of agreement with the mounting angle of the first connector 2 in any direction when attaching the electronic unit 5, having the second connector 3, to the mounting portion 1, the disagreement of the mounting angles of the two connectors 2 and 3 can be corrected by pivotally displacing the first connector 2 in accordance with the angle of advance of the second connector 3.

Therefore, the connector housings 7 and 26 and the support portion thereof will not be subjected to a large bending moment when connecting the two connectors 2 and 3 together, and therefore damage to these housings can be effectively prevented, and also the two connectors 2 and 3 can be easily and positively connected together, so that the terminals in the connector housings 7 and 26 can be properly connected respectively to the mating terminals in the connector housing 26. And besides, there is no need to form any shaft portion and bearing portion on the outer surface of the connector housing 7, and therefore the dimension of the first connector 2 in the direction of the width thereof can be kept to a small value.

In the above embodiment, the cross-shaped slit 10 is formed in the spherical support portion 11 formed at the bottom of the first connector 2, and the support portion 11 can be easily reduced in diameter. With this structure, when connecting the first connector 2 to the holder 4, the support portion 11 is elastically deformed to be reduced in diameter, and by doing so, the support portion 11 can be easily press-fitted into the recessed hole 21 in the holding portion 15.

The recessed hole 21 for receiving more than a half of the support portion 11 is formed in the holding portion 15, and the support portion 11 is held by the holding portion 15 in an embracing manner, and therefore without the need for separate retaining means, the condition of interconnection between the first connector 2 and the holder 4 can be maintained with the simple structure. There may be used an arrangement in which the spherical support portion 11 is formed on the holder 4 while the holding portion 15, having the recess 21 for receiving this support portion 11, is formed in the bottom of the first connector 2.

In the above embodiment, the outwardly-spreading, tapering surface 27 is formed at the front end of the female connector housing 26 of the second connector 3, and therefore when connecting the second connection 3 to the first connection 2, even if the mounting angle of the first connector 2 is much out of agreement with that of the second connector 3, the tapering surface 27 is brought into abutment against the connector housing 7 of the first connector 2, and is guided by it, and the connector housing 26 of the second connector 3 is fitted on the connector housing 7, and thus the disagreement of the mounting angles is effectively corrected, and the two connectors 2 and 3 can be positively connected together.

In the above embodiment, the shake prevention projections 8 are formed respectively on the upper and lower surfaces of the connector housing 7 of the first connector 2, and the pair of small projections 16 for abutment against the associated shake prevention projection 8 in the mounted condition of the first connector 2 are formed on each of the upper and lower sides of the opening 12 in the holder 4. Therefore, opposite side surfaces of the rear portion of each projection 8 are held against the associated small projections 16, thereby preventing the shaking of the first connector 2, and the supported condition of the first connector 2 is effectively stabilized.

In the above embodiment, although the first connector 2 is supported on the mounting portion 1 through the holder 4 mounted on the mounting portion 1 such as an instrument panel of an automobile, the holding portion 15 for holding the support portion 11 may be provided on the mounting portion 1, in which case the first connector 2 is supported directly on the mounting portion 1.

Figure 6:
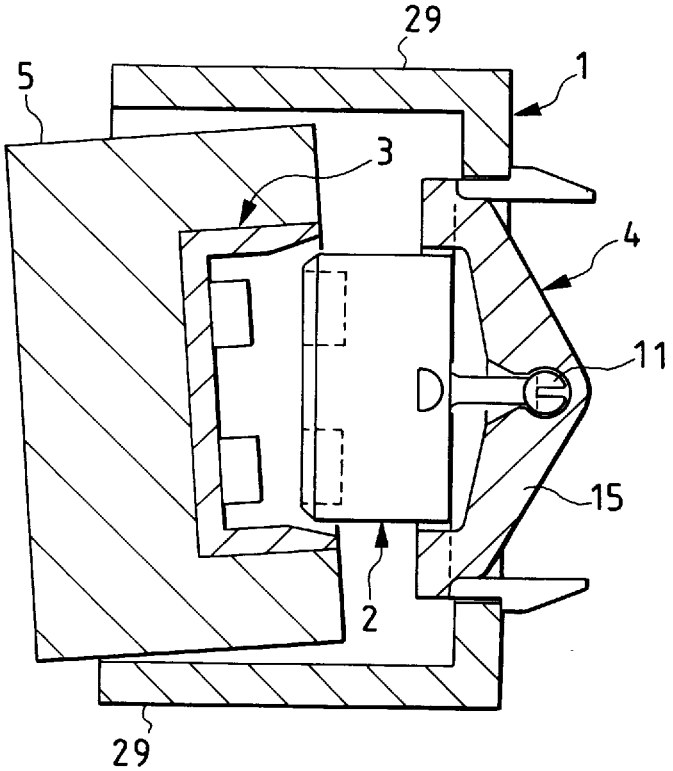
FIG. 6 is a cross-sectional view showing another embodiment of a connector connecting structure of the invention.

As shown in FIG. 6, there may be provided a guide portion 29 which projects from the mounting portion 1, and this guide portion 29 guides the second connector 3, attached to the electronic unit 5, when connecting the second connector 3 to the first connector 2. In this structure, the electronic unit 5 is slidingly moved along the guide portion 29, and the second connector 3, attached to the electronic unit 5, is thus guided so as to correct the disagreement of its mounting angle, and therefore the two connectors 2 and 3 can be connected together more easily and positively.

In the above embodiment, the first connector 2, including the female terminals and the male connector housing 7, is supported on the mounting portion 1 such as an instrument panel of an automobile, and the first connector 2 is supported for pivotal movement about the support portion 11 provided at the bottom of the connector housing 7. Instead of this structure, there may be used a structure in which the support portion 11 or the holding portion 15 is provided at the connector 3 including the male terminals and the female connector housing 26, and this connector is used as a first connector, and this connector is supported on the mounting portion 1.

Instead of the above structure in which the second connector 3 is attached to the electronic unit 5, and this electronic unit 5 is fixed to the mounting portion 1 so as to connect the second connector 3 to the first connector 2 supported on the mounting portion 1, the second connector 3 may be connected directly to the first connector 2 supported on the mounting portion 1.

As described above, the spherical support portion is formed in a projected manner on one of the bottom of the first connector and the wall surface of the mounting portion, while the holding portion for holding the support portion is provided on the other, and when connecting the second connector to the first connector, the first connector is pivotally displaced about the support portion. Therefore, even if the angle of advance of the second connector is out of agreement with the mounting angle of the first connector in any direction when connecting the first and second connectors together, the disagreement of the mounting angles of the two connectors can be corrected by pivotally displacing the first connector in accordance with the angle of advance of the second connector.

Therefore, their connector housings and their supporting portions will not be subjected to a large bending moment when connecting the two connectors together, and therefore damage to them can be effectively prevented, and also the two connectors can be easily and positively connected together, so that the mating terminals in the connector housings can be connected together, and besides there is achieved another advantage that the dimension of the connector in the direction of the width can be kept to a small value.

In addition, the spherical support portion has the slit for enabling the support portion to be reduced in diameter, and the recessed hole for receiving more than a half of the support portion is formed in the holding portion. Therefore, when supporting the first connector on the mounting portion, the support portion is elastically deformed to be reduced in diameter, and can be easily fitted into the recessed hole in the retaining portion to be retained therein in an embracing manner. And besides, without the need for separate retaining means, the condition of interconnection between the first connector can be supported on the mounting portion with the simple structure.

Further, the outwardly-spreading, tapering surface is formed at the front end of the female connector housing constituting one of the first connector and the second connector. Therefore, even if the mounting angle of the first connector is much out of agreement with the mounting angle of the second connector when connecting the two connectors together, the tapering surface is abutted against the male connector, and is guided by it, and the connector housings of the two connectors are connected together. Thus, advantageously, the disagreement of the mounting angles is effectively corrected.

Further, the guide portion for guiding the second connector when connecting the second connector to the first connector is formed on and projects from the mounting portion. Therefore, the second connector is slid along the guide portion, so that the mounting angle of the second connector can be corrected, and the two connectors can be connected together more easily and properly.

The foregoing description of a preferred embodiment of the invention has been presented for purpose of illustration and description. It is not intended to be exhaustive or to limit the invention to the precise form disclosed, and modifications and variations are possible in light of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A connector connecting structure comprising:

a first connector supported on a mounting portion via a holder and containing electrical contacts;

a second connector connectable to said first connector;

a spherical support portion projecting from one of a bottom of said first connector and a wall surface of said holder and electrically insulated from the electrical contacts; and a recessed portion for holding said spherical support portion provided on the other of said bottom of said first connector and said wall surface of said holder;

wherein when connecting said second connector to said first connector, said first connector is pivotally displaceable about said spherical support portion.

2. A connector connection structure according to claim 1, in which said spherical support portion has a slit for enabling said support portion to be reduced in diameter, and a recessed hole for receiving more than a half of said support portion is formed in said holding portion.

3. A connector connecting structure according to claim 1, in which an outwardly-spreading, tapering surface is formed at a front end of a female connector housing constituting one of said first connector and said second connector.

4. A connector connecting structure according to claim 1, in which a guide portion for guiding said second connector when connecting said second connector to said first connector is formed on and projects from said mounting portion.

5. A connector connecting structure according to claim 1, in which a pair of shake prevention projections are formed on first opposite side surfaces of one of said first connector of said holder, and a pair of small projections abutting against said shake prevention projections are formed on second opposite side surfaces of the other of said first connector and said holder confronting with said first opposite side surfaces.

6. A connector connecting structure comprising:

a first connector supported on a mounting portion via a holder;

a second connector connectable to said first connector;

a spherical support portion projecting from one of a bottom of said first connector and a wall surface of said holder;

a recessed portion for holding said support portion provided on the other of said bottom of said first connector and said wall surface of said holder;

a pair of shake prevention projections formed on first opposite side surfaces of one of said first connector and said holder; and a pair of small projections abutting against said shake prevention projections formed on second opposite side surfaces of the other of said first connector and said holder opposite said first opposite side surfaces.

7. A connector connecting structure comprising:

a holder;

a first connector housing supported on said holder and having a first end and a second end, the first end containing at least one first electrical contact; and a second connector housing connectable to said first connector and containing at least one second electrical contact mateable with said at least one first electrical contact;

said second end of said first connector housing and said holder being pivotally attached to each other;

wherein when connecting said second connector housing to said first connector housing, said first connector housing is pivotally displaceable relative to said holder.

8. The connector connecting structure according to claim 7, wherein said first connector housing has at least two of said first electrical contacts, and said second connector housing has at least two of said second electrical contacts.

* * * * *